United States Patent [19]

Alpha

[11] Patent Number: 4,759,129

[45] Date of Patent: Jul. 26, 1988

[54] PENCIL SHARPENER

[76] Inventor: Anthony J. Alpha, P.O. Box 748, Tommie St., Amelia, La. 70340

[21] Appl. No.: 117,540

[22] Filed: Nov. 6, 1987

[51] Int. Cl.[4] ..... B21D 39/00; B43L 23/02

[52] U.S. Cl. ..... 30/452; 30/453; 144/28.6

[58] Field of Search ..... 30/452, 453, 458, 459, 30/451, 90.1–91.1, 109, 110, 111, 112; 144/28.1, 28.11, 28.2, 28.3, 28.6, 28.7, 28.71, 28.72

[56] References Cited

U.S. PATENT DOCUMENTS 2,853,053 9/1958 Hamilton ..... 144/28.6

*Primary Examiner*—Frederick R. Schmidt
*Assistant Examiner*—Maurina Rachuba
*Attorney, Agent, or Firm*—H. Jay Spiegel

[57] ABSTRACT

Disclosed herein is an improved pencil sharpener specifically designed to sharpen the end of a carpenter's pencil. As is well known, a carpenter's pencil has a substantially rectangular cross-section and as such can not be sharpened in a conventional pencil sharpener since conventional pencil sharpeners are designed to be used to sharpen pencils of circular cross-section. The inventive pencil sharpener is able to sharpen a carpenter's pencil by virtue of four cutter heads each of which having a cross-section subtending only a portion of the circumference of a circle and interconnected through gearing so that opposed cutter heads engage the pencil surface while the other cutter heads are spaced away from the pencil surfaces. As the first mentioned cutter heads move away from the pencil surface, the latter mentioned cutter heads rotate into position engaging the pencil surface so that a carpenter's pencil with a rectangular cross-section may be sharpened.

9 Claims, 1 Drawing Sheet

PENCIL SHARPENER

BACKGROUND OF THE INVENTION

Pencil sharpeners having cutter heads and actuable through a rotary hand crank are well known. U.S. Pat. Nos. 819,104 to Webster, 1,393,378 to Johnson and 2,146,890 to Frederick are but three examples of patents disclosing such structure. However, the pencil sharpeners disclosed in each of these patents are limited in that they are specifically designed to sharpen pencils of circular cross-section. Thus, a need has developed for a pencil sharpener designed to sharpen a pencil of other than circular cross-section, particularly, a pencil well known for its use by carpenters, and which has a rectangular cross-section.

SUMMARY OF THE INVENTION

The present invention overcomes the deficiencies found in prior art pencils as exemplified by the above listed and discussed U.S. patents by providing an improved pencil sharpener having structures specifically designed to enable the sharpening of pencils of other than those of circular cross-section. The present invention includes the following interrelated aspects and features:

(a) The inventive pencil sharpener is contained within an oblong housing having a sliding door on its side periphery designed to allow access to the internal chamber thereof to empty wood shavings.

(b) The oblong housing may, if desired, have mounted on its outer surface a file or rasp which may be utilized to create a finer point on the pencil as desired.

(c) An actuator crank protrudes from the housing and is connected to an axle connected at its distal end to a gear and one of four cutting heads.

(d) The four cutting heads are mounted within the housing with each cutting head being mounted on a shaft having connected thereto an actuator gear. The actuator gears of the four cutting heads are enmeshed with the gears having equal numbers of teeth so that each of the cutting heads rotates at the same speed.

(e) Each cutting head subtends less than the circumference of a circle and the cutting heads are mounted in the housing such that when the actuator crank is rotated, only two opposed cutting heads are in engagement with the pencil surface at any given time. Since there are two pairs of opposed cutting heads, these pairs alternately engage the pencil surface as the actuator crank is rotated to thereby cause alternate opposed sides of the pencil surface to be ground down until the pencil is sharpened.

Accordingly, it is a first object of the present invention to provide an improved pencil sharpener.

It is a further object of the present invention to provide an improved pencil sharpener designed specifically to enable the sharpening of pencils of rectangular cross-section.

It is a still further object of the present invention to provide such an improved pencil sharpener having a housing with a sliding door designed to allow emptying of the housing interior and with a file or rasp mounted on the exterior surface of the housing.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
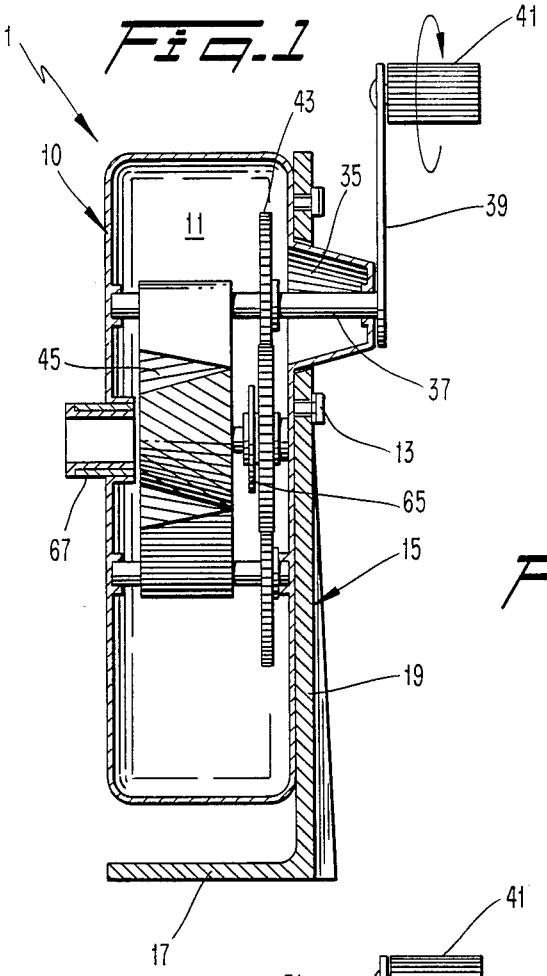
FIG. 1 shows a side view of the present invention with portions of the housing thereof broken away to show detail.
Figure 3:
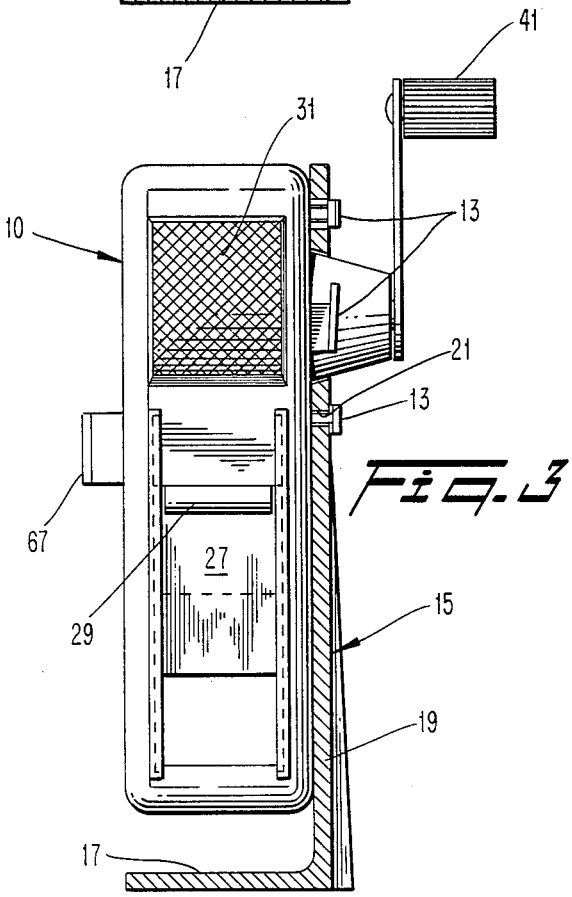
FIG. 3 shows a side view of the present invention.

With reference first to FIG. 1, it is seen that the inventive pencil sharpener 1 includes an oblong housing 10 defining an internal cavity 11. With particular reference to FIG. 3, it is seen that the housing 10 includes a plurality of headed pins 13 on one side thereof which facilitate the mounting of the housing 10 on a special bracket 15 provided for this purpose.

Figure 4:
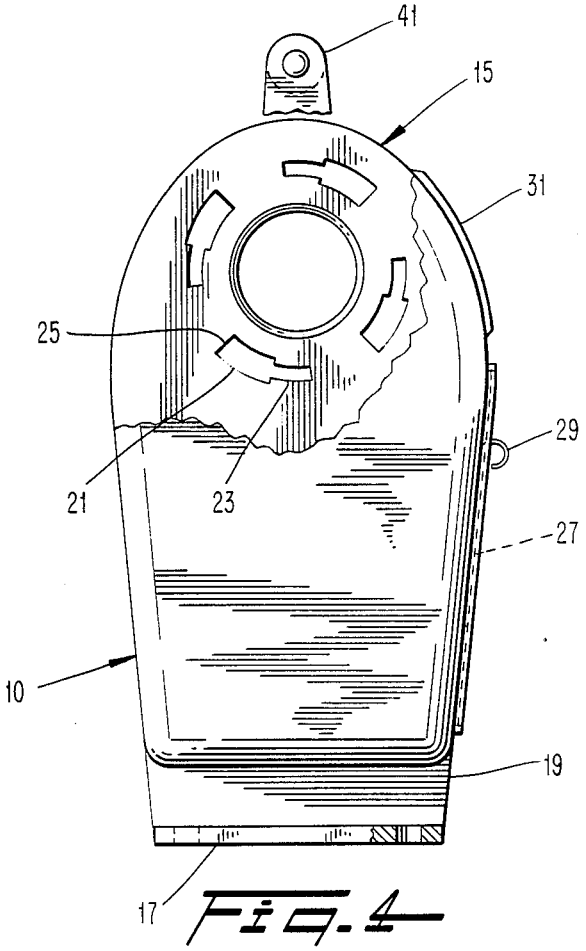
FIG. 4 shows an end view of the invention.

With reference to FIGS. 3 and 4, it is seen that the bracket 15 includes a base 17 which may be mounted on any desired flat surface by virtue of adhesive, screws and the like and an upstanding wall 19 having a plurality of slots 21 therein with each slot being of arcuate nature and having a first arcuate section 23 of narrow width and a second arcuate section 25 which is wider. As should be understood, the heads of the headed pins 13 are so sized that they are able to be inserted through the slot sections 25 but can not be pulled out from the slot sections 23. Thus, the housing 10 may be removably mounted to the bracket 15 by inserting the heads of the headed pins 13 into the arcuate slot sections 25 and thereafter by twisting the housing 10 until the heads of the headed pins 13 are beneath the narrowed arcuate slot sections 23 to thereby lock the housing 10 onto the bracket 15.

With further reference to FIGS. 3 and 4, it is seen that the housing 10 includes an access door 27 including a handle portion 29, with the door 27 allowing access to the chamber 11 when it is desired to empty wood shavings therefrom. If desired, a rasp or file 31 may be attached to the surface of the housing 10 with the file or rasp 31 being utilized to file down a pencil point to a finer condition if desired.

With further reference to FIGS. 1 and 3, it is seen that the housing 10 includes a side opening 35 through which protrudes an actuator including shaft 37, arm 39 and hand crank 41. The shaft 37 extends into the chamber 11, as seen in FIG. 1 and has rigidly affixed thereto a gear 43 with the shaft 37, at its distal end, also having attached thereto a cutter head 45.

Figure 2:
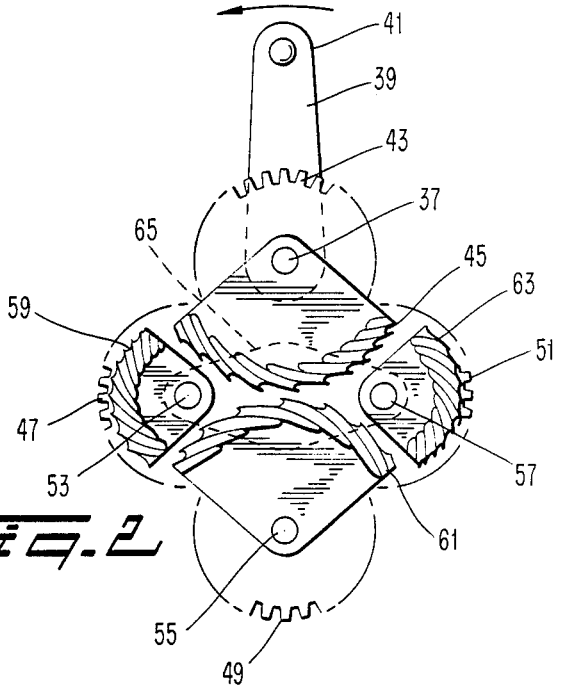
FIG. 2 shows a end view of the cutting heads and actuator gears of the present invention.

With reference to FIG. 2, it is seen the gears 47, 49 and 51 are rotatably mounted in the housing 10 on respective shafts 53, 55 and 57 with these respective shafts also carrying respective cutter heads 59, 61 and 63. As should be understood in the view of FIG. 2, rotation of the arm 39 in a counterclockwise direction will result in rotation of the cutter head 45 in a counterclockwise direction, will cause rotation of the cutter head 59 in a clockwise direction, will result in rotation of the cutter head 61 in a counterclockwise direction and will result in rotation of the cutter head 63 in a clockwise direction.

As should be understood with particular reference to FIG. 2, each of the cutter heads 45, 59, 61 and 63 subtends an angle about the circumference of a circle of significantly less than 360°. In fact, in the preferred embodiment of the present invention, the cutter heads 45 and 61 subtend an angle of approximately 120° while the cutter heads 59 and 63 subtend an angle of approximately 110°. As should be understood from the FIG. 2 showing, only two of the cutter heads are in engagement with the pencil at any given instant. Further, the cutter heads 59 and 63 each have a first radius of curvature whereas the cutter heads 45 and 61 each have a second, significantly larger, radius of curvature. Thus, in the view of FIG. 2, the cutter heads 45 and 61 will be in engagement with the pencil tip while the cutter heads 59 and 63 are out of engagement and facing away therefrom. With continued rotation of the arm 39 and thereby the gears 43, 47, 49 and 51, the cutter heads 45 and 61 will rotate out of engagement with the pencil tip while, simultaneously, the cutter heads 59 and 63 will rotate into engagement with the pencil tip to cut the sides thereof. While the cutter heads all have arcuate surfaces and thereby will cut arcuate surfaces in the pencil tip, since the radii of curvature of the cutter heads is great as compared to the size of the pencil the arcuate nature of the cuts will not significantly effect the use of the pencil.

Each of the cutter heads 45, 59, 61 and 63 includes cutting teeth which are oriented as shown in FIG. 2. This orientation has been specifically designed to most effectively enable the sharpening of a carpenter's pencil.

With further reference to FIG. 1, it is seen that a stop 65 is provided between the cutter heads and the gears which defines where the pencil will be limited as to its lateral insertion into the opening of the bushing 67. If desired, the bushing 67 may be removable from the housing 10 so that bushings with different shaped openings such as elliptical openings may be inserted.

The operation of the present invention should be self-evident from the above description. When it is desired to sharpen a pencil utilizing the inventive sharpener 1, a carpenter's pencil is inserted into the opening of the bushing 67 which is in alignment with the space between the cutter heads. Rotation of the arm 39 by the crank 41 will result in rotation of the gears 43, 47, 49 and 51 resulting in corresponding movements of the cutter heads 45, 59, 61 and 63 whereupon the cutter heads will alternatively cut the elongated opposed surfaces of a carpenter's pencil and the short side surfaces of the pencil. After several revolutions of the arm 39, the carpenter's pencil will be sharpened, whereupon it may be rubbed against the file or rasp 31 to make the point thereof finer. After several pencils have been sharpened, the housing 10 may be removed from the bracket 15 whereupon the door 27 may be opened to empty wood shavings from the chamber 11.

As such, an invention has been disclosed in terms of a preferred embodiment thereof which fulfills each and every one of the objects as set forth hereinabove. Of course, various changes, modifications and alterations in the teachings of the present invention may be contemplated without departing from the intended spirit and scope thereof. In this regard, for example, the leading edges of each cutter head may have to be cut down slightly toward nothing on the trailing edges to avoid jamming of the pencil within the sharpener. Furthermore, additional gears may be provided to provide a different gear ratio than the one to one ratio which is disclosed between rotations of the arm 39 and rotations of the cutter heads. The gear ratio may be set as desired with it being important to consider the amount of force which will be necessary to be applied to the arm to enable rotations of the cutter heads to thereby sharpen the pencil. As such, it is intended that the present invention only be limited by the terms of the appended claims.

I claim:

1. An improved pencil sharpener, comprising:

(a) a bracket having a base and an upstanding portion connected to said base;

(b) a sharpening mechanism comprising:

(i) an actuator shaft bearingly supported by said bracket;

(ii) a first gear fixed to said shaft and meshing with second, third and fourth gears rotatably supported on said bracket, said second and fourth gears engaging said first gear with said third gear engaging said second and fourth gears and being opposed to said first gear;

(iii) first, second, third and fourth cutter heads fixedly mounted, respectively, to said first, second, third and fourth gears, each said cutter head subtending an arc of less than a semi-circle;

(iv) said cutter heads being so mounted on said gears such that when said first and third cutter heads face one another, said second and fourth cutter heads face away from one another, and vice-versa;

(v) whereby said pencil sharpener may sharpen pencils of non-circular cross section.

2. The invention of claim 1, wherein said actuator shaft has a crank mounted thereto.

3. The invention of claim 1, wherein a casing is detachably attached to said bracket and includes a first opening aligned with a second opening between said cutter heads.

4. The invention of claim 3 wherein said casing includes an internal chamber and an access door accessing said chamber.

5. The invention of claim 3, wherein said casing has included thereon an outer surface having a rasp surface.

6. The invention of claim 1, wherein said second and fourth cutter heads have a first radius of curvative and said first and third cutter heads have a second larger radius of curvature.

7. The invention of claim 6, wherein all of said gears have the same number of gear teeth.

8. The invention of claim 3, wherein said casing includes a first surface facing a second surface on said bracket, in assembly, said second surface including a plurality of circumferentially spaced arcuate slots adapted to releasably receive respective headed fasteners extending outwardly from said first surface to releasably attach said casing to said bracket.

9. The invention of claim 3, wherein said first opening is within a bushing detachably connected to said casing, said first opening being shaped to slidably receive a pencil to be sharpened.

* * * * *